US009003637B2

(12) United States Patent
Lee et al.

(10) Patent No.: US 9,003,637 B2
(45) Date of Patent: Apr. 14, 2015

(54) METHOD OF MANUFACTURING A MICROPHONE ASSEMBLY

(75) Inventors: Dong Sun Lee, Gyeonggi-do (KR); Hyoung Joo Kim, Incheon (KR)

(73) Assignee: BSE Co., Ltd., Incheon (KR)

( * ) Notice: Subject to any disclaimer, the term of this patent is extended or adjusted under 35 U.S.C. 154(b) by 189 days.

(21) Appl. No.: 13/528,969

(22) Filed: Jun. 21, 2012

(65) Prior Publication Data

US 2013/0142374 A1 Jun. 6, 2013

(30) Foreign Application Priority Data

Dec. 5, 2011 (KR) ..... 10-2011-0128912

(51) Int. Cl.

| | |
|---|---|
| ***H04R 31/00*** | (2006.01) |
| ***H04R 1/04*** | (2006.01) |
| *H04R 1/08* | (2006.01) |
| *H04R 1/10* | (2006.01) |

(52) U.S. Cl.

CPC .. *H04R 1/04* (2013.01); *H04R 1/08* (2013.01); *H04R 1/10* (2013.01); *H04R 31/00* (2013.01); *Y10T 29/49005* (2015.01)

(58) Field of Classification Search

CPC ..... H04R 1/1016; H04R 1/105; H04R 1/04; H04R 19/04; H04R 1/08; H04R 25/407; H04R 25/604; H04R 25/652; H04R 25/658; H04R 31/006; H04R 3/00; H04R 1/02; H04R 1/1066; H04R 1/1075; H04R 9/08; H04R 31/0006

USPC ..... 29/417, 592.1, 594, 609, 609.1; 381/352, 355, 357, 358, 360, 361, 365, 381/368, 369; 257/704, 723, 724, 729, 730

See application file for complete search history.

(56) References Cited

U.S. PATENT DOCUMENTS

| | | | | |
|---|---|---|---|---|
| 6,018,584 | A * | 1/2000 | Paulick | 381/122 |
| 7,620,191 | B2 * | 11/2009 | Tanabe et al. | 381/174 |
| 7,687,723 | B2 * | 3/2010 | Izuchi et al. | 174/260 |
| 7,835,533 | B2 * | 11/2010 | Yonehara et al. | 381/150 |
| 8,050,443 | B2 * | 11/2011 | Izuchi et al. | 381/357 |
| 8,295,528 | B2 * | 10/2012 | Rombach et al. | 381/369 |
| 8,300,870 | B2 * | 10/2012 | Lee et al. | 381/352 |
| 8,369,544 | B2 * | 2/2013 | Andersen | 381/173 |
| 8,553,921 | B2 * | 10/2013 | Yao et al. | 381/360 |

FOREIGN PATENT DOCUMENTS

| | | |
|---|---|---|
| KR | 10-0617113 B1 | 11/2005 |
| KR | 10-0703324 B1 | 9/2006 |

* cited by examiner

*Primary Examiner* — Paul D Kim
(74) *Attorney, Agent, or Firm* — Ladas & Parry LLP

(57) ABSTRACT

A method of manufacturing a microphone assembly having an ear set function includes assembling a mike cell unit; obtaining a region for connection with the mike cell unit on a PCB, mounting only a conductive member in the region, and mounting other remaining components outside the region; adhering the mike cell unit to a corresponding region of the PCB; and sealing an adhering portion between the mike cell unit and the PCB. Assembling the mike cell unit includes inserting a mike cell case having a sound hole and a curing portion into a diaphragm assembly; stacking a spacer on the diaphragm assembly; inserting a back electrode plate into an insulating ring base; mounting the insulating ring base on the spacer; mounting a metal ring base on the insulating ring base; and curing or clamping a curing portion of the mike cell case.

2 Claims, 7 Drawing Sheets

METHOD OF MANUFACTURING A MICROPHONE ASSEMBLY

CROSS-REFERENCE TO RELATED PATENT APPLICATION

This application claims the benefit of Korean Patent Application No. 10-2011-0128912, filed on Dec. 5, 2011, in the Korean Intellectual Property Office, the disclosure of which is incorporated herein in its entirety by reference.

BACKGROUND OF THE INVENTION

1. Field of the Invention

The present invention relates to a microphone assembly for an ear set, and more particularly, to a microphone assembly having an ear set function, in which a microphone component and an ear set component are formed on the same printed circuit board (PCB) to reduce the number of components and to increase a back chamber, thereby having increased sensitivity, and a method of manufacturing the microphone assembly.

2. Description of the Related Art

In general, an ear set is a small-sized device that is installed on a user's ears and includes a speaker for converting an electric signal into an acoustic signal and a microphone for converting an acoustic signal into an electric signal. Since an ear set is used together with a portable terminal, a user can make a call without holding the portable terminal. An MPEG Audio Layer-3 (MP3) function is basically provided in a portable terminal. Thus, recently, ear sets have been gradually used both for listening to music and conversations. An ear set is classified into a hanger type ear set and an insertion type ear set according to a method of installing the ear set on a user's ears.

In general, a hanger type ear set includes a body, a speaker installed on an end portion of the body, a microphone installed on the other end portion of the body, and an ear hook that extends from a predetermined portion of the body to be hung on a user's ear. Since a hanger type ear set is easily fixed to a user's ears, hanger type ear sets are being widely used in Bluetooth (wireless) ear sets containing a heavy battery. An insertion type ear set includes speakers installed in a user's ears and a printed circuit board (PCB) assembly that is connected to the speakers via wires, is spaced apart from the speaker by a predetermined length, and includes a microphone and ear-set components mounted thereon. The insertion type ear set is a typical type ear set that is fixed to a user's ears by inserting speakers into the user's ears. An example of a hanger type ear set is the 'under the ear wearable ear set' disclosed in KR 10-0703324. An example of an insertion type ear set is the 'ear-microphone for a cellular phone' disclosed in KR 10-0617113.

SUMMARY OF THE INVENTION

In a conventional ear set or ear mike, since a microphone printed circuit board (PCB) on which a separate circuit structure for a mike function is mounted and a PCB on which a circuit structure for an ear set function is mounted are separately used, the mike function and the ear set function are combined via a surface mounting technology (SMT) process during the manufacture of the ear set or ear mike, and thus, the properties of a microphone are changed during the SMT process.

The present invention provides a microphone assembly having an ear set function, the microphone assembly including both a microphone PCB and an ear set PCB such that the number of components and manufacturing processes are reduced, thereby reducing the manufacturing costs and not using an SMT process for a mike cell unit so that the properties of a microphone remain constant, and a method of manufacturing the microphone assembly.

The present invention also provides a microphone assembly having an ear set function, the microphone assembly including circuit components disposed outside a mike region so as to increase an area of a back chamber, thereby the microphone assembly having increase sensitivity, and a method of manufacturing the microphone assembly. In this regard, conventionally, the circuit components are disposed inside the mike region.

The present invention also provides a microphone assembly having an ear set function, the microphone assembly being manufactured by using a mike cell unit based on an electret condenser mike, and a method of manufacturing the microphone assembly.

According to an aspect of the present invention, there is provided a microphone assembly having an ear set function, including a mike cell unit; and a printed circuit board (PCB) assembly that is coupled to the mike cell unit and on which components for a microphone function and components for the ear set function are mounted.

The microphone assembly may further include a sealing member for sealing a space between the mike cell unit and the PCB assembly or a component case for protecting components mounted on the PCB assembly.

In addition, the PCB assembly may include a PCB; a conductive member that is mounted on a PCB region so as to be coupled to the mike cell unit and electrically connect the mike cell unit and the PCB assembly; and mount components mounted on a portion of an upper surface of the PCB or a lower surface of the PCB. The conductive member may include at least one of a coil spring, a leaf spring, a socket, and a pogo pin.

The mike cell unit may include a mike cell case comprising a sound hole and a curing portion; a diaphragm assembly inserted into the mike cell case; a spacer that is inserted into the mike cell case and is stacked on the diaphragm assembly; a back electrode plate that is inserted into the mike cell unit and stacked on the spacer; an insulating ring base that is inserted into the mike cell unit, allows the back electrode plate to be properly positioned, and is formed of a non-conductive material for preventing the mike cell case from being grounded, and internal components may be fixed by a curing or clamping process of the mike cell case; and a metal ring base that is inserted into the mike cell case, is stacked on the insulating ring base, fixes the internal components during the curing or clamping process, permanently transmits a uniform pressure to the mike cell case, and is formed of metal.

According to another aspect of the present invention, there is provided a method of manufacturing a microphone assembly having an ear set function, the method including assembling a mike cell unit; obtaining a region for connection with the mike cell unit on a PCB, mounting only a conductive member on the region, and mounting other remaining components outside the region; adhering the mike cell unit to a corresponding region of the PCB; and sealing an adhering portion between the mike cell unit and the PCB. The method may further include adhering a component case to the PCB for electrostatically shielding the other remaining components mounted outside the region. The assembling of the mike cell unit may include inserting a mike cell case comprising a sound hole and a curing portion into a diaphragm assembly; stacking a spacer on the diaphragm assembly; inserting a back electrode plate into an insulating ring base to be coupled to each other; mounting the insulating ring base coupled to the back electrode plate on the spacer; mounting a metal ring base on the insulating ring base; and curing or clamping a curing portion of the mike cell case.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, the present invention will be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
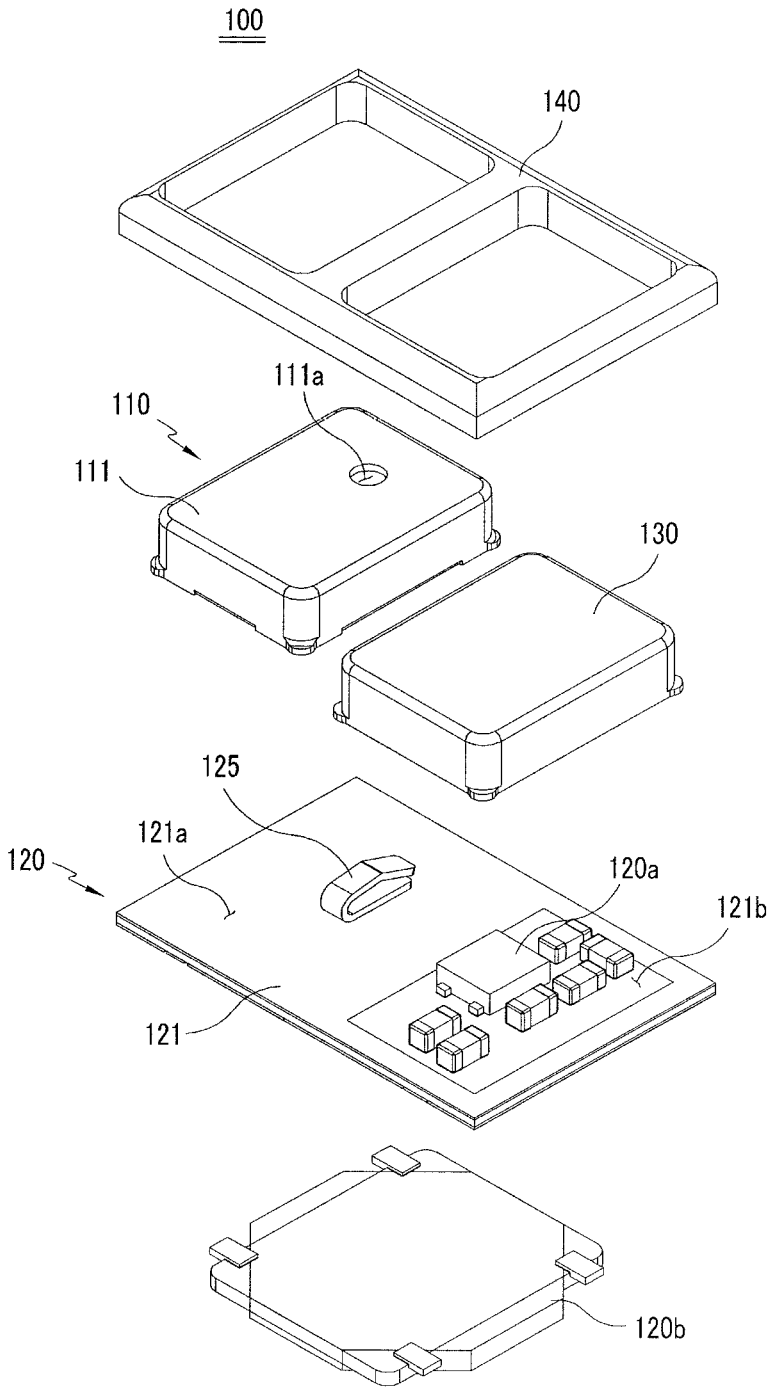
FIG. 1 is an exploded perspective view of a microphone assembly having an ear set function, according to an embodiment of the present invention.
Figure 2:
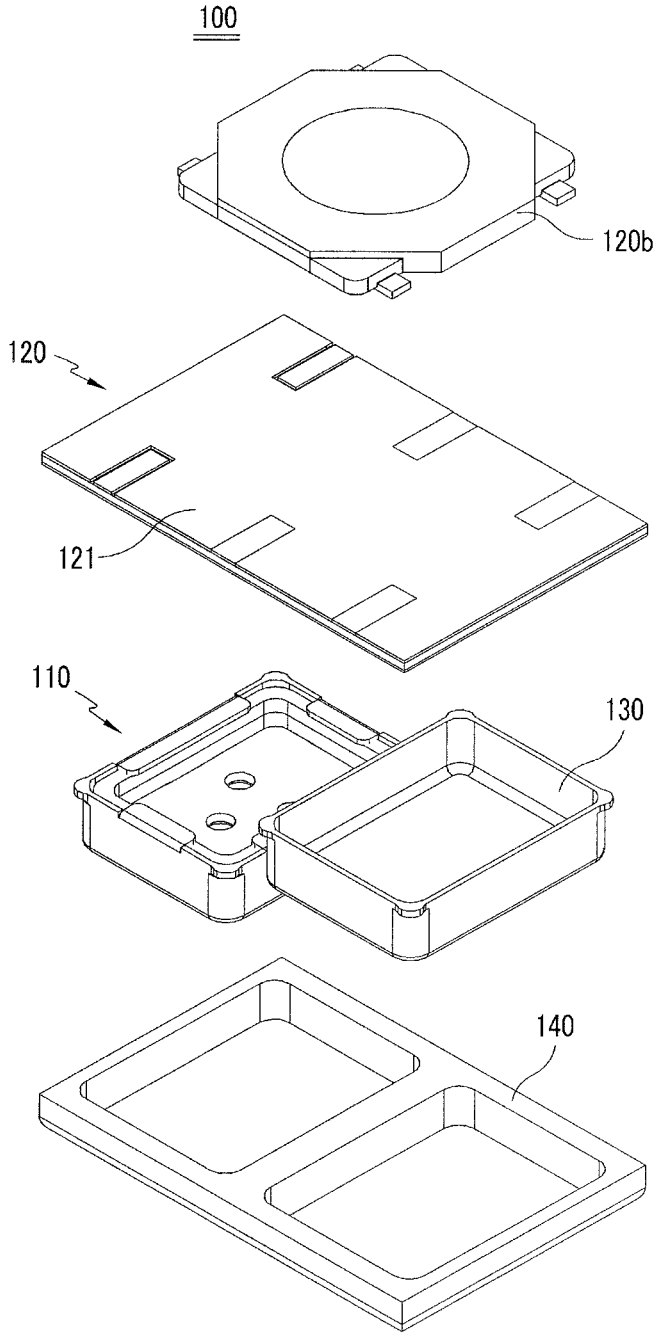
FIG. 2 is a reversed exploded perspective view of a microphone assembly of FIG. 1, according to an embodiment of the present invention.

FIG. 1 is an exploded perspective view of a microphone assembly 100 having an ear set function, according to an embodiment of the present invention. FIG. 2 is a reversed exploded perspective view of a microphone assembly 100 of FIG. 1, according to an embodiment of the present invention.

Referring to FIGS. 1 and 2, the microphone assembly 100 includes a mike cell unit 110, a printed circuit board (PCB) assembly 120 on which components for a microphone function and components for an ear set function are mounted, a component case 130 for protecting the components mounted on the PCB assembly 120, and a sealing member 140 for sealing a space between the mike cell unit 110 and a PCB 121.

The PCB assembly 120 is a multifunctional component obtained by combining the microphone function and the ear set function, and includes the PCB 121, a conductive member 125 that is mounted on a PCB region 121*a* so as to be coupled to the mike cell unit 110 and electrically connects the mike cell unit 110 and the PCB assembly 120 to each other, upper mount components 120*a* mounted on a portion 121*b* of an upper surface of the PCB 121, and lower mount components 120*b* mounted on a lower surface of the PCB 121. Although not shown in FIGS. 1 and 2, the PCB assembly 120 may include a harness and terminals for connecting components. The upper mount components 120*a* may include field effect transistors (FETs) for the microphone function or chip components for the ear set function, such as an amplifier, a capacitor, or a resistor. The lower mount components 120*b* may include a volume controlling switch for the ear set function, a battery power source, or the like.

In addition, the conductive member 125 may be a conductive component having structural elasticity for transferring signals between the mike cell unit 110 and the PCB 121 and may be, for example, a coil spring, a leaf spring, a connector, a socket, a pogo pin, or the like.

Figure 3:
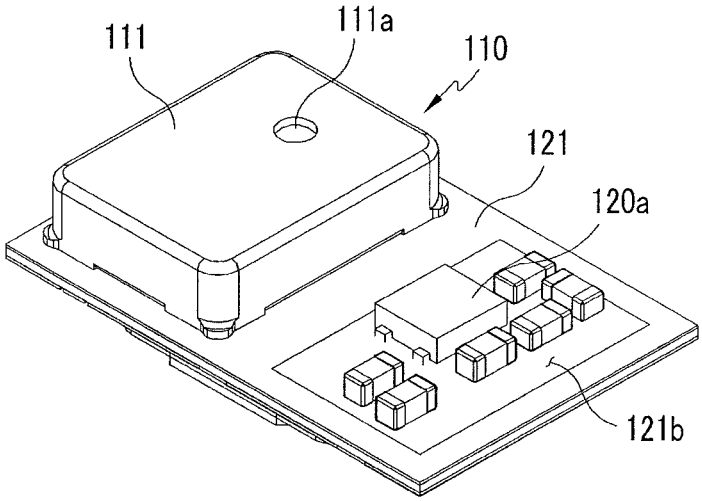
FIG. 3 is a perspective view showing a first process of a microphone assembly according to an embodiment of the present invention.
Figure 4:
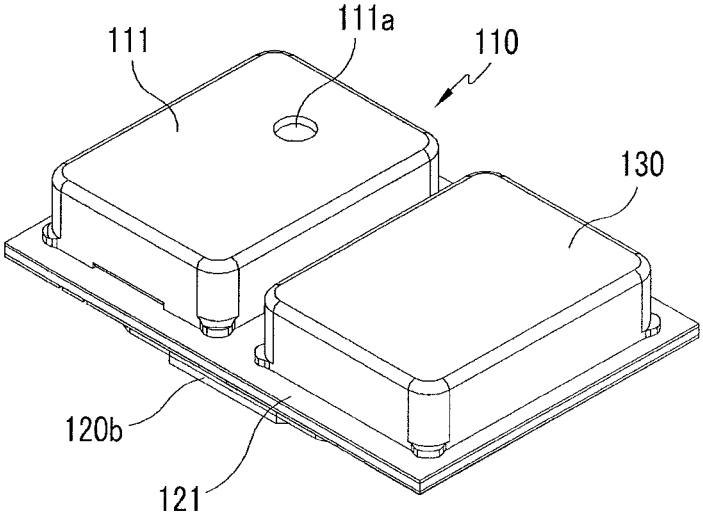
FIG. 4 is a perspective view showing a second process of a microphone assembly according to an embodiment of the present invention.

FIG. 3 is a perspective view showing a first process of the microphone assembly 100 according to an embodiment of the present invention. FIG. 4 is a perspective view showing a second process of the microphone assembly 100 according to an embodiment of the present invention.

According to the present embodiment, referring to FIG. 3, the microphone and ear set functions may be easily embedded in the microphone assembly 100 by omitting a surface mounting technology (SMT) process in a process of mounting the mike cell unit 110 since the mike cell unit 110 including electret is adhered to the PCB assembly 120, on which components are mounted via a SMT process, via laser welding or welding. In addition, according to the present embodiment, a case of the mike cell unit 110 may be grounded via various methods such as a welding process, a SMT process, or the like, and SMT members such as a FET, a chip, or the like are disposed outside the mike cell unit 110, thereby obtaining a wide area of an inner chamber to maximize the sensitivity efficiency of the microphone assembly 100, compared with a conventional structure.

In addition, according to the present embodiment, in order to shield sound noise of an upper mount chip, a shield can structure may be formed to surround the component case 130 and an acoustic sealing material may be coated on the component case 130, thereby preventing sounds from leaking through a gasket, a housing, or the like, as shown in FIG. 4.

Figure 5:
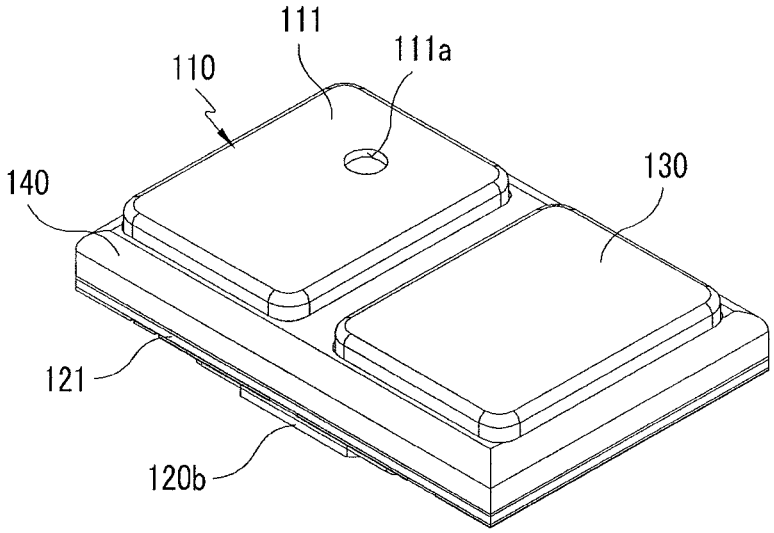
FIG. 5 is a perspective view showing a case where a microphone assembly is assembled, according to an embodiment of the present invention.
Figure 6:
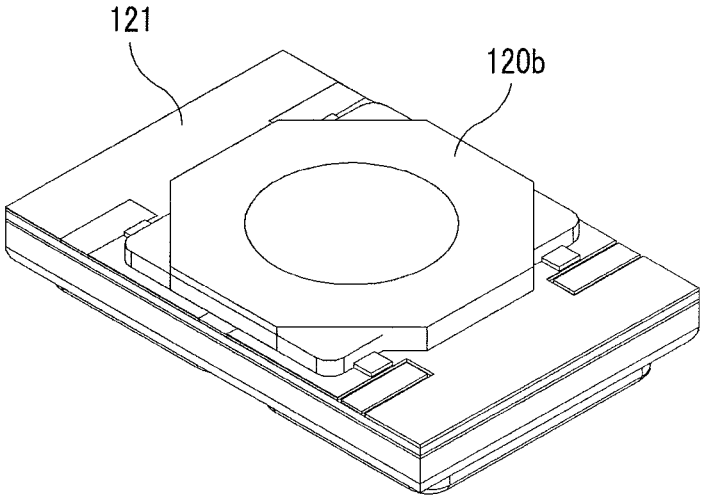
FIG. 6 is a reversed perspective view showing a case where a microphone assembly is assembled, according to an embodiment of the present invention.
Figure 7:
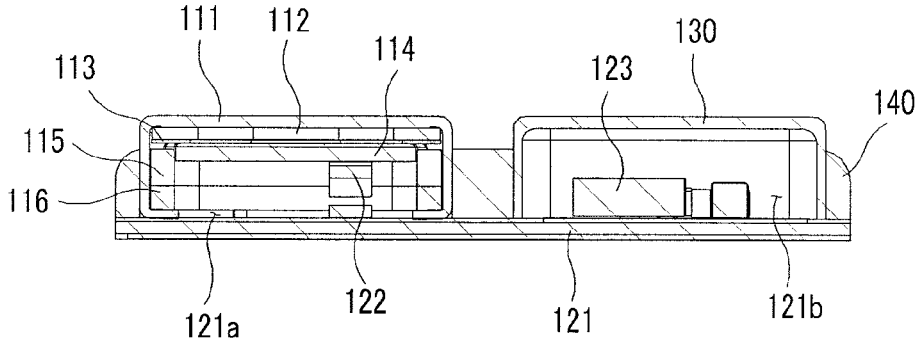
FIG. 7 is a side cross-sectional view of a microphone assembly according to an embodiment of the present invention.

FIG. 5 is a perspective view showing a case where the microphone assembly 100 is assembled, according to an embodiment of the present invention. FIG. 6 is a reversed perspective view showing a case where the microphone assembly 100 is assembled, according to an embodiment of the present invention. FIG. 7 is a side cross-sectional view of the microphone assembly 100 according to an embodiment of the present invention.

According to the present embodiment, as shown in FIGS. 5 through 7, the completed microphone assembly 100 includes the mike cell unit 110, the PCB assembly 120 that is coupled to the mike cell unit 110 and on which components for a microphone function and components for an ear set function are mounted, the sealing member 140 for sealing a space between the mike cell unit 110 and the PCB assembly 120, and the component case 130 for electrostatically shielding components mounted on the PCB assembly 120.

The PCB assembly 120 includes the PCB 121, the conductive member 125 that is mounted on the PCB region 121*a* for connection with the mike cell unit 110 and electrically connects the mike cell unit 110 and the PCB assembly 120 to each other, and the upper and lower mount components 120*a* and 120*b* that are respectively mounted on a portion of an upper surface of the PCB 121 and a lower surface of the PCB 121. The conductive member 125 may be, for example, a coil spring, a leaf spring, a connector, a socket, a pogo pin, or the like. According to the present embodiment, the conductive member 125 may have a leaf spring structure.

In the completed microphone assembly 100, one electrode of a power supplier is connected to a diaphragm assembly 112 through a grounding pattern of the PCB 121 and a mike cell case 111 and the other electrode of the power supplier is connected to a back electrode plate 114 through the conductive member 125 to charge the two electrodes. In addition, when an acoustic signal is input to the mike cell unit 110, the diaphragm assembly 112 vibrates, which changes the electrostatic capacity of the mike cell unit 110. The acoustic signal is transmitted to an FET mounted outside the mike cell unit 110 along a signal pattern of the PCB 121 and is processed by the FET. In this case, since components for a microphone function, such as an FET, are disposed outside the mike cell unit 110, an area of a back chamber may be increased, thereby increasing sensitivity and improving sound quality. In addition, since components for an ear set function are also mounted on the PCB assembly 120, the ear set function together may be obtained together with the microphone function.

Figure 8:
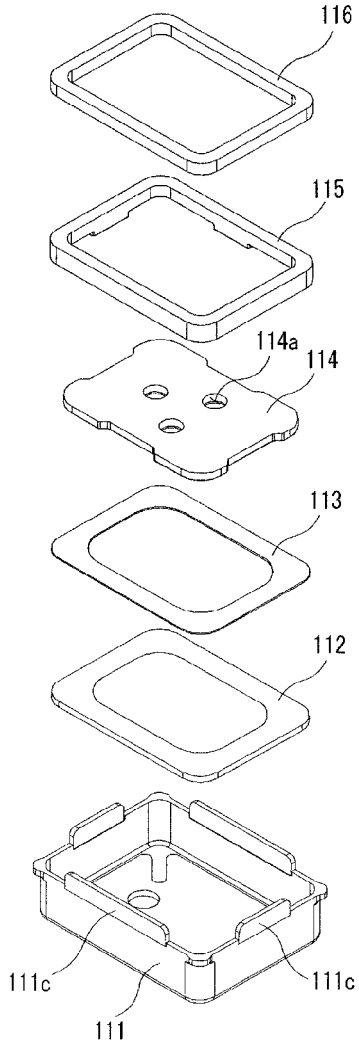
FIG. 8 is an exploded perspective view of a mike cell unit according to an embodiment of the present invention.
Figure 9:
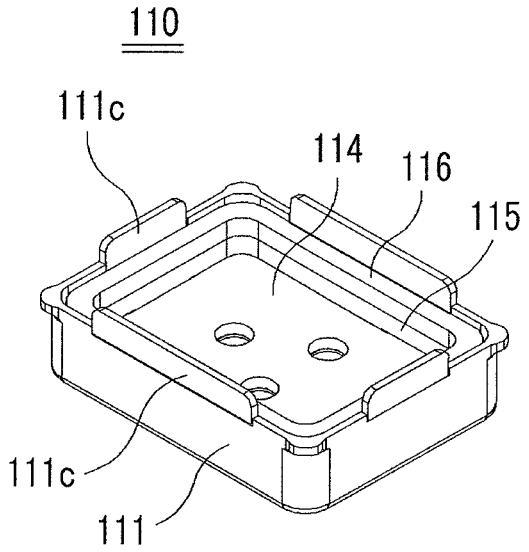
FIG. 9 is a perspective view of a case where a mike cell unit is not cured, according to an embodiment of the present invention.
Figure 10:
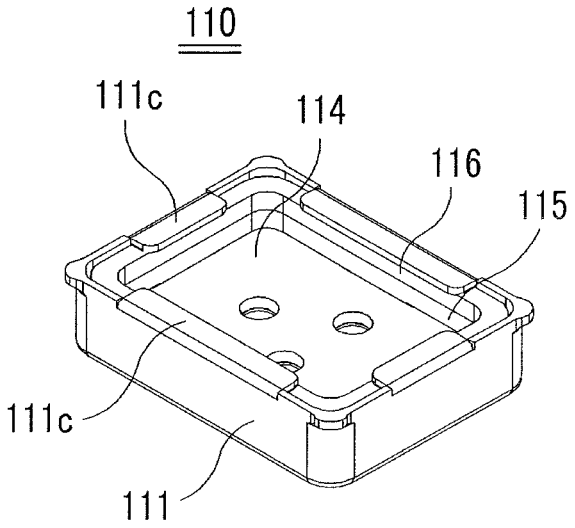
FIG. 10 is a perspective view of a case where a mike cell unit is cured, according to an embodiment of the present invention.
Figure 11:
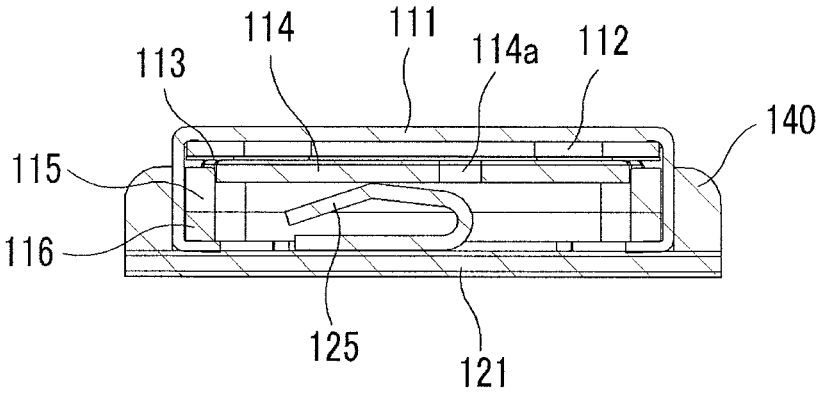
FIG. 11 is a side cross-sectional view of a mike cell unit, according to an embodiment of the present invention.

FIG. 8 is an exploded perspective view of the mike cell unit 110 according to an embodiment of the present invention. FIG. 9 is a perspective view of a case where the mike cell unit 110 is not cured, according to an embodiment of the present invention. FIG. 10 is a perspective view of a case where the mike cell unit 110 is cured, according to an embodiment of the present invention. FIG. 11 is a side cross-sectional view of the mike cell unit 110, according to an embodiment of the present invention.

According to the present embodiment, as shown in FIGS. 8 through 11, the mike cell unit 110 includes a mike cell case 111 including a sound hole and a curing portion 111*c*, the diaphragm assembly 112 inserted into the mike cell case 111, a spacer 113 that is inserted into the mike cell case 111 and stacked on the diaphragm assembly 112, the back electrode plate 114, an insulating ring base 115, and a metal ring base 116, and has a structure in which four lateral sides of the mike cell case 111 are fixed by being deformed and folded (that is, a curing or clamping process) via a press structure, wherein the back electrode plate 114 is inserted into the mike cell case 111, includes high-molecular weight materials exhibiting permanent charges, and is stacked on the spacer 113, the insulating ring base 115 is inserted into the mike cell case 111, allows the back electrode plate 114 to be properly positioned, and is formed of a non-conductive material for preventing the mike cell case 111 from being grounded, and the metal ring base 116 is inserted into the mike cell case 111, is stacked on the insulating ring base 115, fixes internal components during a curing or clamping process by structurally deforming the four lateral sides of the mike cell case 111, permanently transmits a uniform pressure to the mike cell case 111, and is formed of metal.

Figure 12:
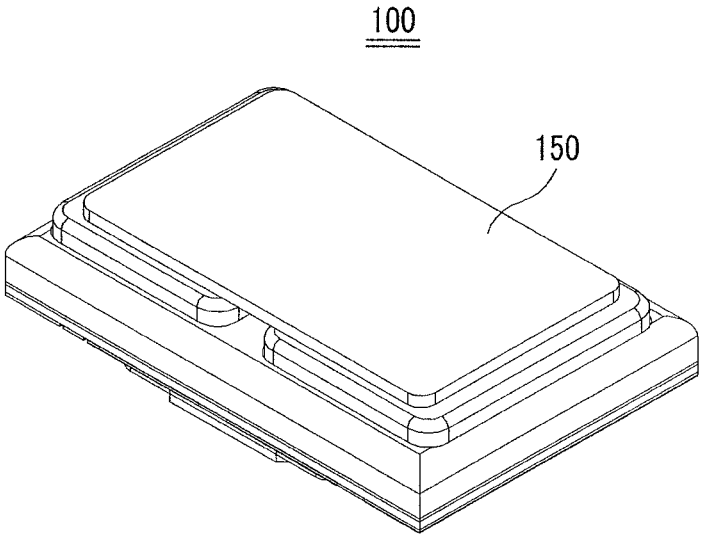
FIG. 12 is a perspective view of a case where non-woven fabric is attached to a microphone assembly according to an embodiment of the present invention.

FIG. 12 is a perspective view of a case where non-woven fabric 150 is attached to the microphone assembly 100 according to an embodiment of the present invention.

As shown in FIG. 12, in the microphone assembly 100 according to the present embodiment, an entire surface containing the sound hole 111*a* is surrounded by the non-woven fabric 150 such that impurities may be prevented from penetrating into the mike cell unit 110 and a buffering effect may be increased, thereby protecting components from shocks.

According to the one or more embodiments of the present invention, since a microphone assembly has a function used in an ear set, a single product, that is, a microphone may have an ear set function without using a separate component so as to reduce the number of required components, thereby reducing the fraction defective and volume of the microphone.

Conventionally, a back chamber is limited by a chip required for a circuit inside a PCB of a microphone. However, according to the one or more embodiments of the present invention, the microphone assembly may maximize an area of a back chamber even in cases where microphones have the same height, thereby the microphones having high sensitivity.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of manufacturing a microphone assembly having an ear set function, the method comprising:

assembling a mike cell unit;

obtaining a region for connection with the mike cell unit on a printed circuit board (PCB), mounting only a conductive member in the region, and mounting other remaining components outside the region;

adhering the mike cell unit to the region of the PCB; and sealing an adhering portion between the mike cell unit and the PCB, wherein the assembling of the mike cell unit comprises:

inserting a mike cell case comprising a sound hole and a curing portion into a diaphragm assembly;

stacking a spacer on the diaphragm assembly;

inserting a back electrode plate into an insulating ring base to be coupled to each other;

mounting the insulating ring base coupled to the back electrode plate on the spacer;

mounting a metal ring base on the insulating ring base; and curing or clamping the curing portion of the mike cell case.

2. The method of claim 1, further comprising adhering a component case to the PCB for electrostatically shielding the other remaining components mounted outside the region.

* * * * *